US007077043B1

(12) United States Patent
Koerble et al.

(10) Patent No.: US 7,077,043 B1
(45) Date of Patent: Jul. 18, 2006

(54) WORKPIECE CARRIER FOR A SAW

(75) Inventors: Thomas Norton Koerble, 2043 W. Creedy Rd., Beloit, WI (US) 53511; John Michael Haegler Koerble, Owatonna, MN (US)

(73) Assignee: Thomas Norton Koerble, Beloit, WI (US)

( * ) Notice: Subject to any disclaimer, the term of this patent is extended or adjusted under 35 U.S.C. 154(b) by 0 days.

(21) Appl. No.: 09/490,370

(22) Filed: Jan. 24, 2000

Related U.S. Application Data

(60) Provisional application No. 60/117,692, filed on Jan. 29, 1999.

(51) Int. Cl.
*B27B 25/00* (2006.01)
*B27B 29/10* (2006.01)

(52) U.S. Cl. ..... 83/719; 83/412; 83/435.11; 83/435.27; 83/477.2; 83/727; 83/729; 83/730; 144/204.2

(58) Field of Classification Search ..... 83/435.11, 83/435.15, 435.27, 713, 714, 717, 727, 729, 83/730, 409, 409.1, 412, 415, 423, 425, 437.1, 83/477.2, 719, 722, 743; 125/13.01; 144/204.2; 269/58, 60
See application file for complete search history.

(56) References Cited

U.S. PATENT DOCUMENTS 1,651,846 A 12/1927 Stauder
2,085,236 A * 6/1937 Tautz ..... 144/204.2 X
2,597,355 A * 5/1952 Masuy ..... 83/727 X
2,752,960 A * 7/1956 Poeltl ..... 83/409 X
2,895,513 A * 7/1959 Cowley ..... 83/435.11 X
4,026,173 A 5/1977 Livick
4,155,283 A 5/1979 Mericle
4,165,668 A 8/1979 McCord, Jr.
4,206,672 A 6/1980 Smith
4,206,910 A 6/1980 Biesemeyer
4,259,887 A 4/1981 Dean
4,367,668 A 1/1983 Jensen
4,481,846 A 11/1984 Goodell
4,655,445 A 4/1987 Morse
4,658,686 A * 4/1987 Woods ..... 83/425
4,677,887 A 7/1987 Martin
4,693,156 A 9/1987 Olvera
4,699,346 A 10/1987 Bahm
4,702,137 A 10/1987 Davidson et al.
4,732,182 A 3/1988 Gorsha
4,732,184 A 3/1988 Albright
4,741,387 A 5/1988 Strong
4,805,500 A 2/1989 Saito et al.
4,909,111 A 3/1990 Noble
5,016,358 A 5/1991 Rice et al.
5,016,508 A 5/1991 Hallenbeck
5,038,486 A 8/1991 Ducate, Sr.
5,109,742 A 5/1992 Strong
5,190,271 A 3/1993 Otterbein, II
5,301,726 A 4/1994 Wojcik
5,443,554 A 8/1995 Robert
5,662,019 A 9/1997 Denman
5,664,612 A 9/1997 Klemma
5,823,239 A 10/1998 Smith

* cited by examiner

*Primary Examiner*—Clark F. Dexter

(57) ABSTRACT

A carrier adapted to securely hold a workpiece for manual movement through cutting engagement such as with the saw blade of a band saw in a manner that allows for precise and predictable cutting of the workpiece into boards of desired thickness. The carrier is slidably positioned in the miter guide slot that extends in the saw work table parallel to the cut of the saw blade, and is adapted for manual positioning of the workpiece transversely with respect to the guide slot to adjust the depth of cut of the blade into the workpiece.

1 Claim, 6 Drawing Sheets

WORKPIECE CARRIER FOR A SAW

CROSS-REFERENCES TO RELATED APPLICATIONS

This application claims priority to U.S. Provisional Patent Application Ser. No. 60/117,692, filed Jan. 29, 1999.

REFERENCE TO MICROFICHE APPENDIX

Not applicable.

STATEMENT REGARDING FEDERALLY SPONSORED RESEARCH OR DEVELOPMENT

Not applicable.

BACKGROUND OF THE INVENTION

1. Field of Invention

The present invention relates generally to a workpiece carrier which, while suitable for other uses, is especially useful in connection with cutting boards of a desired thickness with a conventional band saw of the type having a table top work surface provided with a miter guide slot extending parallel to the direction of cut of the saw blade such as commonly found in home workshops and certain commercial environments.

More particularly, the invention relates to a workpiece carrier adapted for use with such power equipment having a cutting, shaping or abrasive tool, and which provides for both sliding movement of the carrier on the table and the workpiece through cutting engagement with the tool, and positioning of the workpiece transversely thereto for adjusting the depth of cut into the workpiece.

2. Description of Prior Art

Cabinetmakers, hobbyists and other woodworkers use a variety of board lumber sizes for the fabrication of various articles, and there are times when a desired board is of a non-standard thickness or material. Locating such non-standard boards can be difficult, and if located, they may be relatively expensive.

One alternative to searching for or paying relatively high prices for a non-standard board is to cut the desired board from a standard size commercially available board. However, this can sometimes be a difficult task, due in part, because there is no prior holder that both conveniently holds the board to be cut and is easily adjustable to establish the thickness of the desired non-standard board.

In other instances, a suitable standard board may not be available from which the desired non-standard board can be cut. In such instances, particularly where the board is to be made from a non-standard material, it would be advantageous to be able to cut the desired board from a log or unfinished chunk of the non-standard material. Again, however, there is no suitable prior holder available to both securely hold a non-standard sized or shaped article and provide adjustment to obtain the thickness of the desired board.

Certain prior miter-type devices may be used for cutting a board from a workpiece. However, such devices do not provide for secure connection to the workpiece, and they do not provide for ease of precision adjustment of the workpiece transverse to the saw blade. Instead, use of such devices requires the operator to hold the workpiece in position against a guide, and the guide must be manually slid to the desired position prior to locking into place.

Thus, to enable the cutting of boards of a non-standard thickness, from a non-standard material, or from a non-standard size or shaped workpiece, and thereby promote the availability and reduce the cost of obtaining non-standard boards, there is a need for a workpiece holder that is suitable for securely holding both standard boards and non-standard articles, and that is also easily adjustable for establishing the thickness of the desired board.

Safe operation of saws and other power woodworking equipment is always of concern. During more recent times, substantial effort has been made to provide guards, safety switches and other safety devices for such power equipment. However, there has been little improvement during this time in carriers for securely holding a workpiece during the cutting of a board therefrom, particularly as it relates to the cutting of boards with equipment of the type typically found in home workshops and smaller commercial environments.

For example, cutting a board of a non-standard thickness from a thicker standard board is typically accomplished by locating a fence parallel to the direction of cut of the saw blade, and then pushing the standard sized board through the saw blade while holding it against the fence to obtain the desired thickness in the resulting board. However, such techniques are generally dangerous since the board is not securely held in position against the fence, and particularly as the downstream end of the board is pushed through cutting engagement with the saw blade. The dangers associated with such techniques can be reduced if two people are involved in the ripping operation, with one person attending to the upstream end of the board and the other person pushing the board through the saw. Such techniques also tend to result in boards that are not a precise constant thickness, again because the boards are not securely held parallel to the cutting direction of the saw blade during cutting engagement therewith.

Thus, there is also need for a workpiece holder that promotes safe operation of a power band saw and other power table-type equipment by securely holding a workpiece from which a board of a desired thickness can be cut, that promotes precision cutting by securing the workpiece in parallel relation to the saw blade during the cutting of the desired board, and that can be safely and easily operated by one person.

SUMMARY OF THE INVENTION

The general aim of the present invention is to provide a new and improved workpiece carrier suitable for use with band saws of the type having a flat work table provided with a miter guide slot extending parallel to the direction of cut of the saw blade, and adapted to securely hold both standard and non-standard size and shape workpieces to enable the cutting of precision boards of a desired thickness therefrom.

A detailed objective is to achieve the foregoing by providing a carrier that includes provision for sliding the workpiece on the table along a path parallel to the cut of the saw blade, and for easily adjusting the location of the workpiece transversely thereto to establish the thickness of the board to be cut from the workpiece.

These and other objectives and advantages of the invention will become more apparent from the following detailed description when taken in conjunction with the accompanying drawings.

Briefly, a carrier according to the invention includes (i) a base provided with a guide bar extending downwardly therefrom and slidably received in the miter guide slot of the saw work table, a manually graspable handle to enable sliding the carrier along the guide slot, and a slide track extending transverse to the guide bar, (ii) a holder adapted for secure connection of the workpiece and slidably positioned in the track for translation transverse to the guide bar, and (iii) a manually operable drive mechanism operably connected between the base and the holder to enable controlled adjustment of the transverse position of the holder in the track and thus transverse position of the workpiece with respect to the blade.

During use, the workpiece is securely connected to the holder and the guide bar is slidably positioned into the guide slot of the work table. Rotation of the drive screw moves the holder on the base transversely to the direction of cut of the saw to establish the depth of the cut into the workpiece. The use of a threaded screw drive for adjusting the workpiece allows for an infinite range of thickness to be cut from the workpiece. After adjustment of the drive screw, the desired cut is made by sliding the carrier along the guide slot, causing the workpiece to pass through cutting engagement with the saw blade.

With this arrangement, the carrier of the present invention enables precision cuts through both standard and non-standard workpieces, including relatively thick workpieces such as a log, a block of steel, a block of plastic, or other materials which have properties that allow cutting by a saw blade. The carrier also enables a single individual to position, hold and maneuver the workpiece on the working surface of the saw in a way that allows for precise, predictable and safe cutting.

Figure 1:
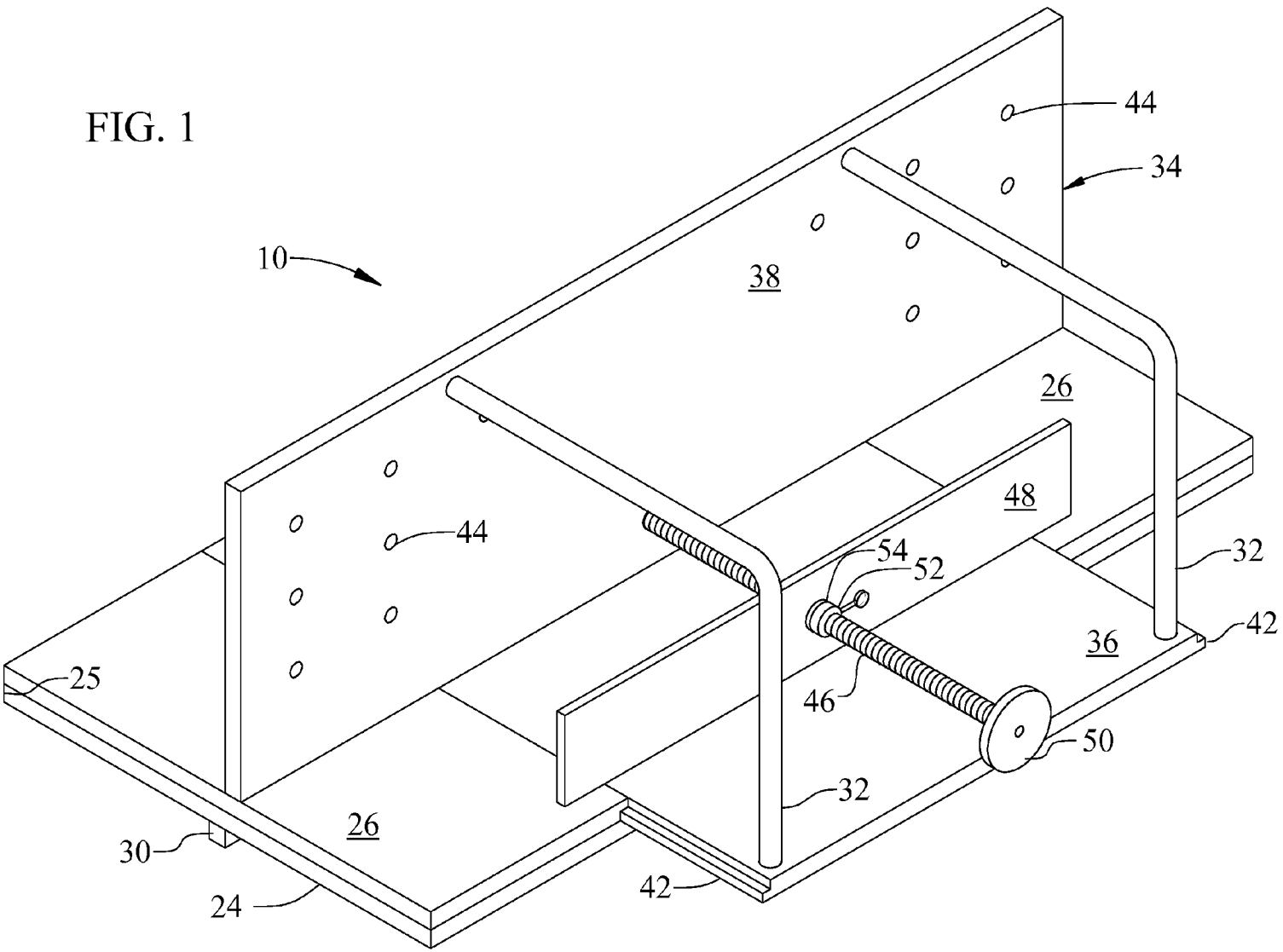
FIG. 1 is a perspective view of a new and improved workpiece carrier incorporating the unique aspects of the present invention.
Figures 2, 2A:
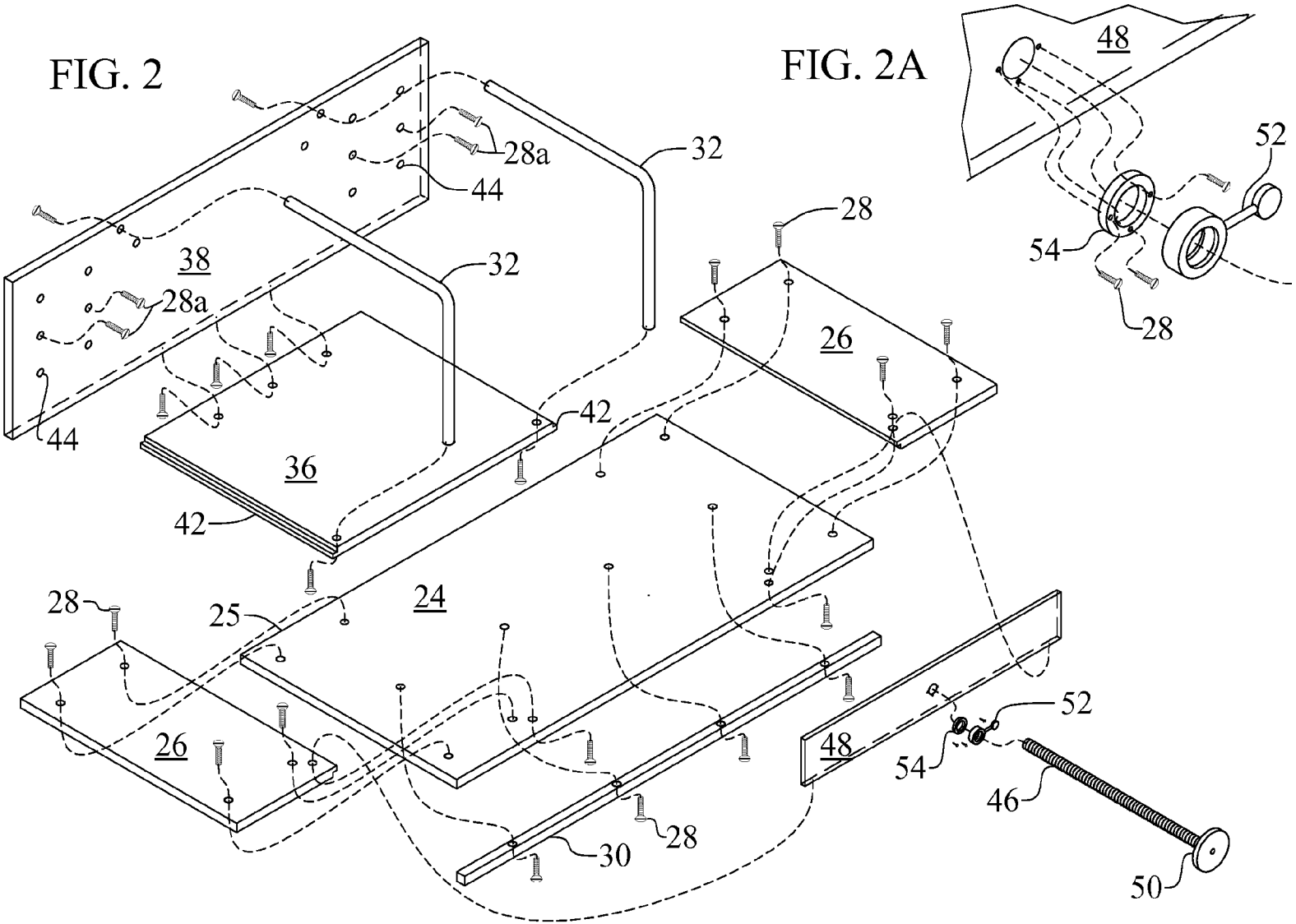
FIG. 2 is an exploded perspective view of the carrier of FIG. 1.
FIG. 2A is an enlarged fragmentary exploded perspective view of certain parts shown in FIG. 2.
Figure 3:
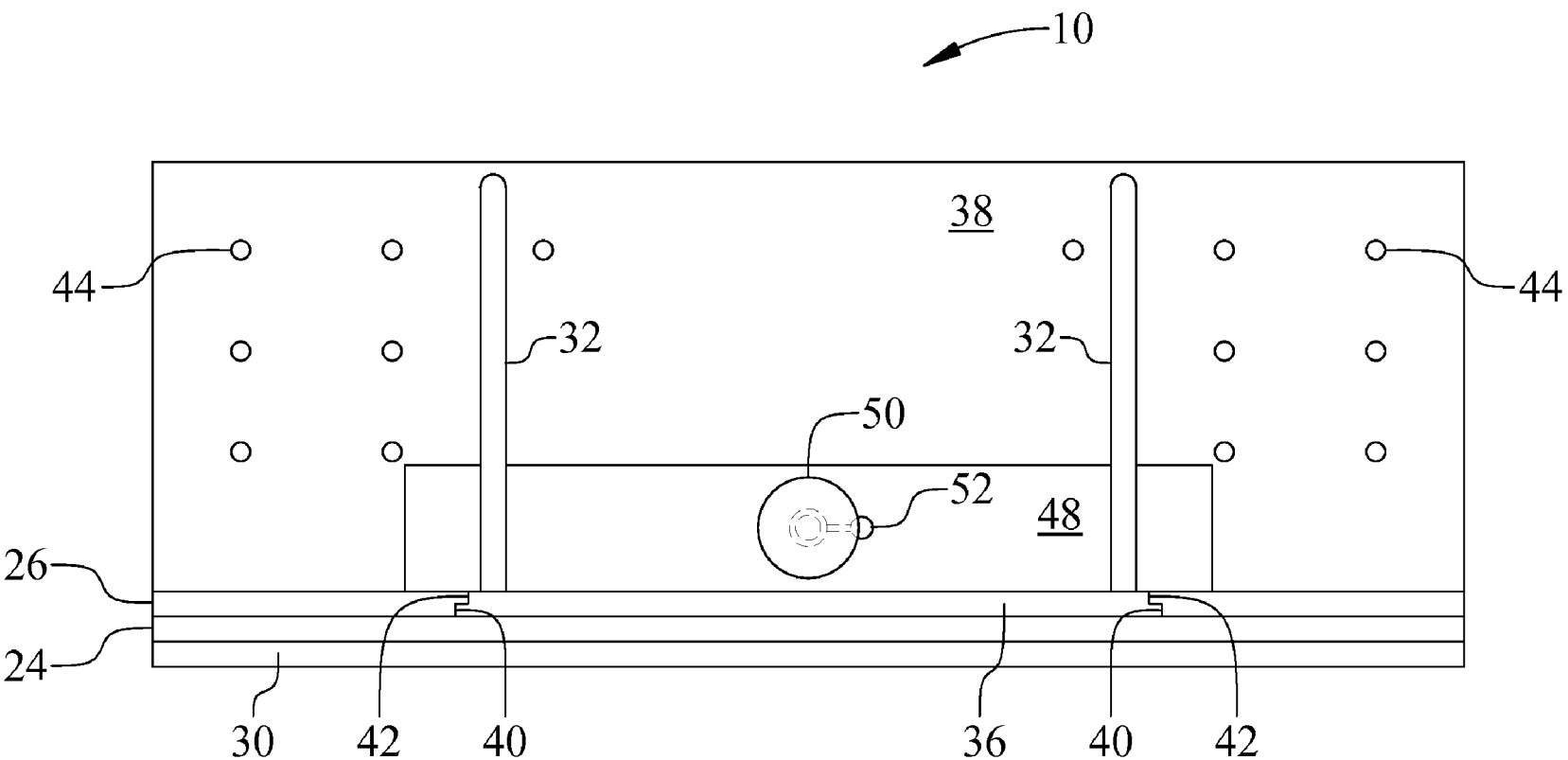
FIG. 3 is a back view of the carrier of FIG. 1.
Figure 4:
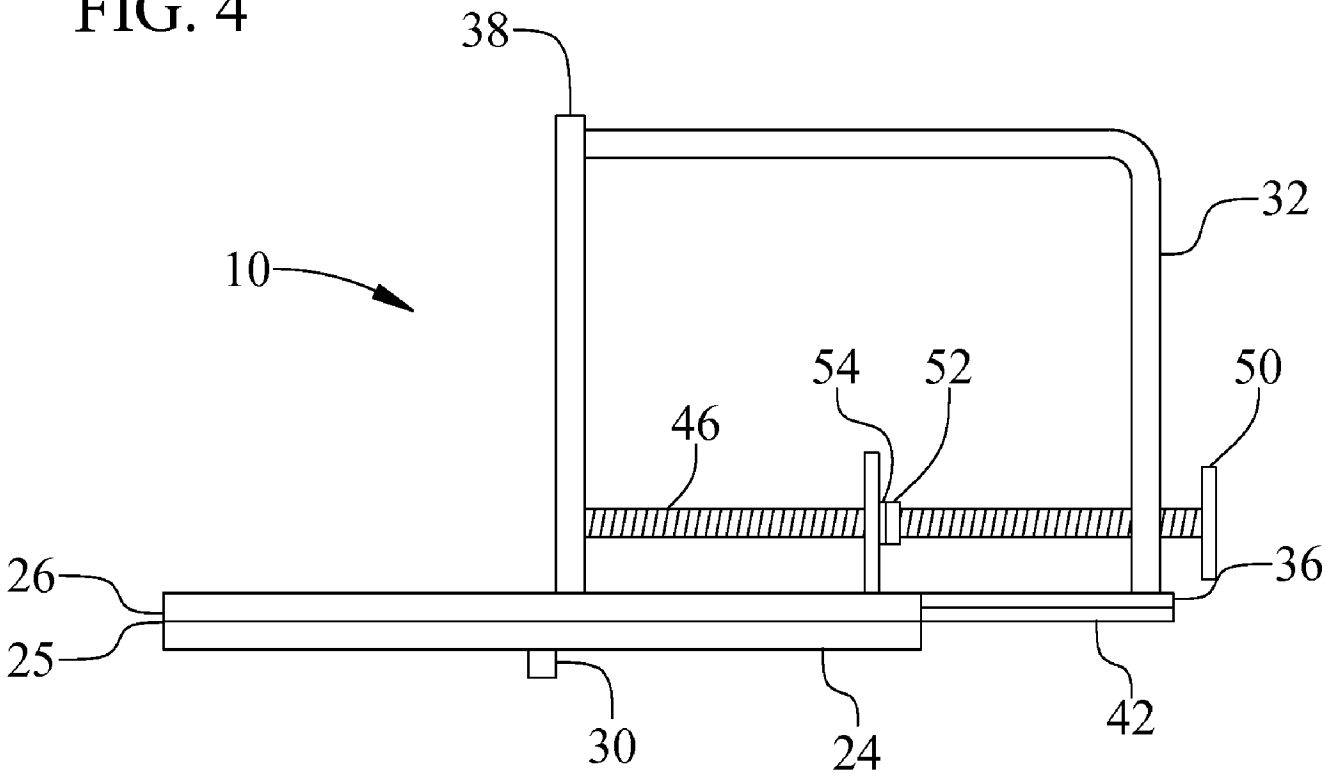
FIG. 4 is a side view of the carrier of FIG. 1.

Reference numerals shown in the drawings correspond to the following items:

10—carrier
12—saw
14—saw table
16—guide slot in saw table
18—saw blade
20—workpiece in form of log
22—board being cut from log
24—base plate
25—front edge of base plate
26—side retaining members
28—fasteners
30—guide bar
32—handles
34—holder
36—slide member
38—mounting plate
40—tracks
42—rails
44—apertures
46—threaded drive screw
48—control arm
50—knob
52—lock nut
54—mounting nut While the invention is susceptible of various modifications and alternative constructions, a certain illustrated embodiment has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE INVENTION

Figure 6:
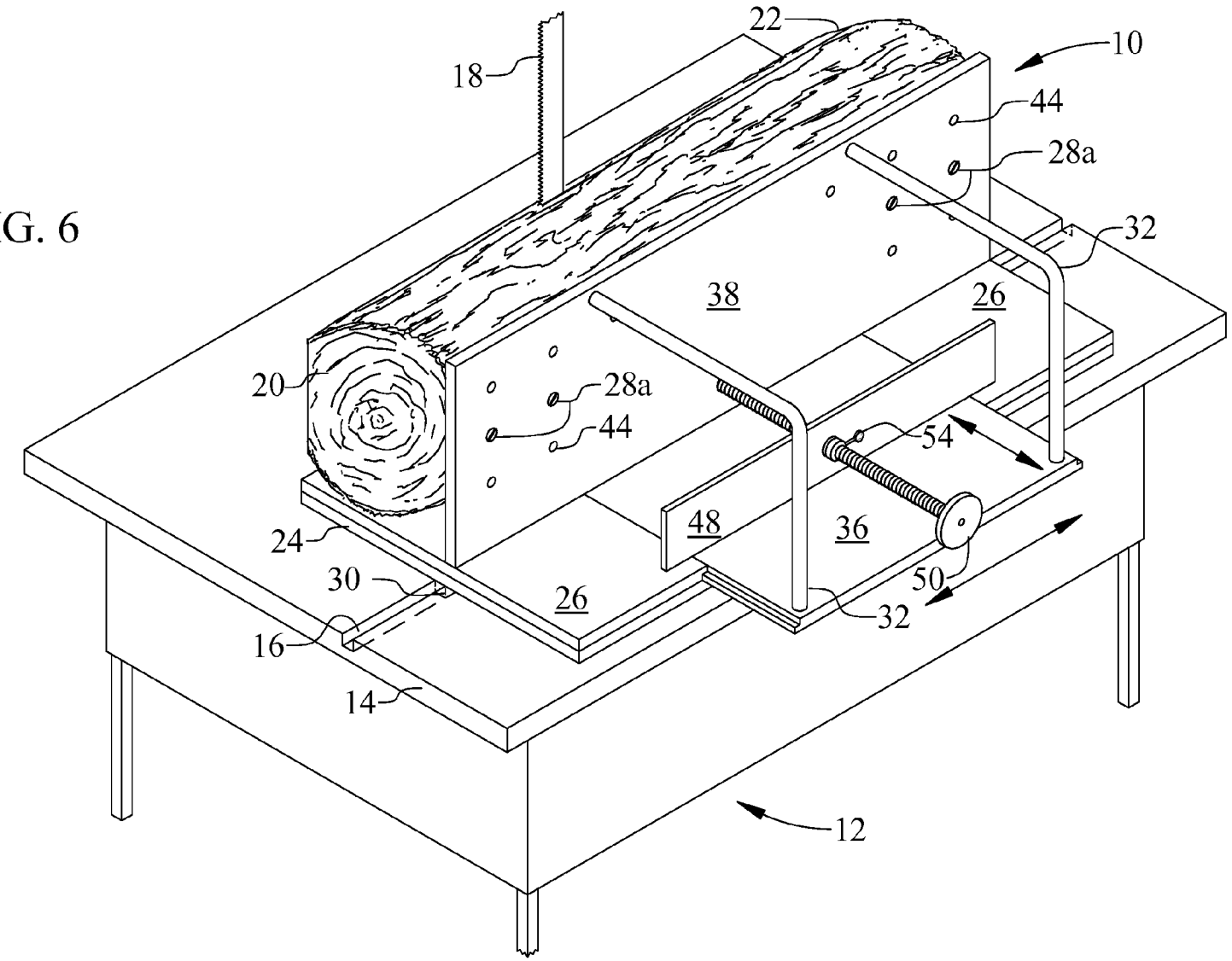
FIG. 6 is a view of the carrier of FIG. 1 as used in connection with a band saw.

For purposes of illustration, the present invention is shown in the drawings as embodied in a workpiece carrier 10 (FIG. 1) in use with a band saw 12 (FIG. 6) having a flat table 14 provided with a meter guide slot 16 that runs parallel to the direction of cut of the saw blade 18, and cutting a board 22 from a workpiece 20 in the form of a log.

In accordance with the invention, the carrier 10 is adapted for securely holding both standard and non-standard workpieces, for sliding movement of the workpiece on the table 14 along a path parallel to the direction of cut of the saw blade 18, and for positioning of the workpiece transversely to said parallel path to adjust the depth of cut of the saw blade into the workpiece.

In carrying out the invention, the carrier 10 includes a base plate 24 having a front edge 25 and top and bottom surfaces extending rearwardly from the front edge 25 for slidably resting on the saw table 14, and a guide bar 30 projecting downwardly from the base plate and sized to be snugly but slidably received into the guide slot 16 for sliding movement of the carrier along said parallel path. Manual sliding of the carrier along this path is enabled by manually graspable handles 32 that are connected in fixed relation to the base plate with respect to said parallel path.

Threaded fasteners 28 are generally shown for connecting the guide bar 30 to the base plate 24, as well as connecting certain other components together as shown in the drawings and discussed below. It will be understood, however, that other fastening techniques may alternately be used for connecting such parts together, and that certain of the combined components may alternately be formed integral with one another.

Figure 5:
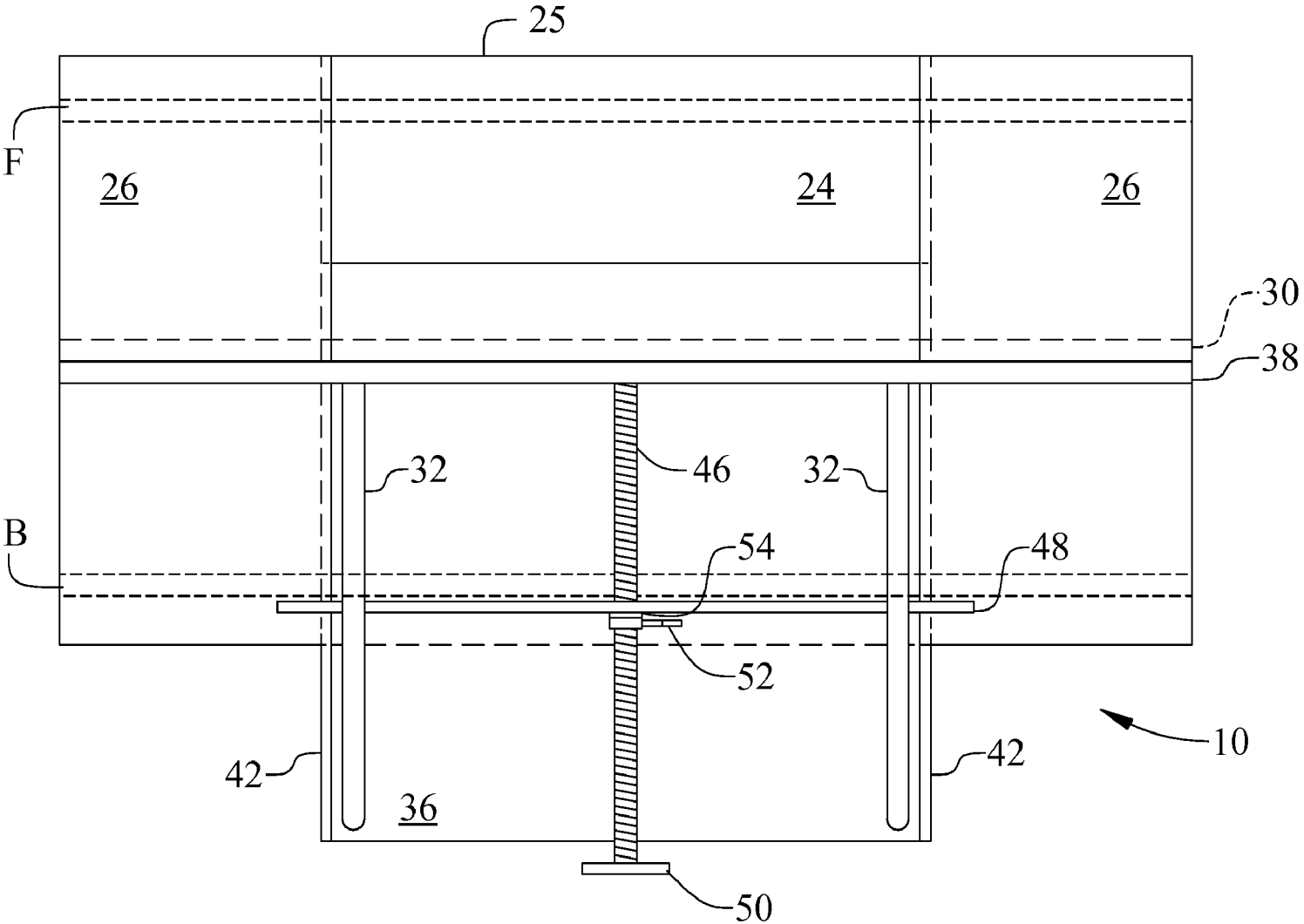
FIG. 5 is a top view of the carrier of FIG. 1.

In further carrying out the invention, the carrier 10 includes a workpiece holder 34 having a slide member 36 slidably connected to the base plate 24, for sliding movement transverse to the direction of the cut of the saw blade 18, toward and away from the front of the base plate, between front and back position such as indicated in dashed lines in FIG. 5 and identified with the reference letters "F" and "B" respectively, and a mounting plate 38 extending upwardly and longitudinally (i.e., generally parallel to the guide bar 30) from the end portion of the slide member proximate the saw blade.

In the embodiment shown, the slide member 36 is slidably retained by a pair of side retaining members 26 connected to the base plate 24. In this instance, the side retaining members 26 are formed with inwardly extending lips spaced from the base plate to define slots 40 sized to slidably receive complimentary shaped rails 42 formed along the sides of the slide member.

The mounting plate is provided with a series of apertures 44 sized to receive fastening devices, such as the screws 28*a* shown, or clamps or vises or other fastening apparatus, for releasably securing a workpiece thereto.

Transverse movement of the holder 34 toward and away from the saw blade is effected with a manually operable threaded drive screw 46 that is mounted for rotation relative to the base plate 24. In the embodiment shown, the drive screw is threaded through a mounting nut 54 that is connected to a control arm 48 which is in turn connected in fixed relation to the base plate 24 outwardly of the slide member 36 via the side retaining members 26. The drive screw is provided with a turning knob 50 at its free end, is threaded through the fixed control arm, and is rotatably affixed to the mounting plate 38 at its opposite end such that turning the knob and drive screw in one direction adjusts the position of the holder along the slots 40 either toward or away from the saw blade, and turning the knob and drive screw in the opposite direction adjusts the position of the holder along the slots 40 in the opposite direction. A manually operable locking nut 52 is provided on the drive screw, for engagement with the control arm, to lock the drive screw in position after manual adjustment thereof.

In the embodiment shown, the handles 32 are connected between the slide member 36 and the mounting plate 38 such that they are held fixed to the base plate 24 with respect said path parallel to the cut of the saw blade 18. In other words, although the handles slide in the base plate 24 toward and away from the cutting tool with the slide member 36 and the mounting plate 38, the handles do not move transversely thereto with respect to the base plate 24. As a result, the handles enable manual sliding of the entire carrier along the guide slot 16 in the work table 14, and thus along a path parallel to the normal direction of the cut of the saw blade.

With the foregoing arrangement, a workpiece such as the log 20 is secured to the holder for transverse movement therewith such as against the forward face of the mounting plate with fasteners extending through the apertures 44 and screwed into the back side of the workpiece. If not previously in position on the table, the carrier and attached workpiece are then positioned on the work table 14, with the guide bar 30 slidably positioned in the guide slot 16 of the work table.

The transverse position of the workpiece 20, i.e., the position of the workpiece relative to the saw blade 18, is adjusted by manual rotation of the drive screw 46 which is then locked into place with the locking nut 52. This establishes the depth cut of the saw blade relative to the mounting plate 38, and thus, the thickness of the board to be cut from the workpiece. After the desired adjustments are made, the handles 32 are grasped and the carrier and workpiece are moved manually across the work table (such as from left to right with the saw shown) along a path parallel to the direction of cut of the saw blade, the carrier being guided by the sliding relationship between the guide bar and the miter guide slot of the work table. This movement will cut a board or stock of the desired thickness from the outer edge portion of the workpiece. After each cut, the carrier and workpiece are returned to a location spaced ahead of the saw blade (i.e., slid to the left of the blade shown), and the transverse position of the holder is manually re-adjusted forwardly to establish the depth of the next cut, i.e., the thickness of the next board to be cut from the workpiece.

To avoid damage to or dulling of the teeth of the saw blade, the fasteners extending through openings 44 and used to attach the workpiece to the mounting plate 38 are preferably of a length that they extend into the workpiece a distance less than the thickness of the last cut from the workpiece.

As will be evident, the carrier of the present invention is also suitable for use with other power cutting tools such as table sanders, table routers, table circular saws and other power saws and cutting and shaping apparatus provided with a work table and associated miter guide slot, and a cutting or abrasive band or blade or shaping or sanding surface operatively associated therewith. The carrier is therefore also suitable for other uses such as for sanding, trimming and shaping the edges of a workpiece.

From the foregoing, it will be apparent that the present invention brings to the art a new workpiece carrier suitable for holding workpieces of both standard and non-standard sizes and shapes, and which, by virtue of providing for controlled sliding along the work table guide slot, and adjustment of the workpiece transversely thereto, uniquely adapted to assist in cutting boards of a desired thickness from the workpiece, or otherwise permitting controlled cutting and shaping of the edge portions of the workpiece.

We claim:

1. A workpiece carrier for use with a power saw having (i) a flat work table provided with a guide slot, and (ii) a cutting tool extending above the work table for cutting a workpiece, the workpiece carrier comprising:

(a) a horizontal base for supporting a workpiece, the base having a front, a back and opposite sides, and having a top and a bottom for sliding on the work table, (b) a guide bar secured to the bottom of the base for sliding positioning in the guide slot in the work table, the guide bar extending longitudinally toward said opposite sides and downwardly from the bottom of the base, (c) a slide member slidably engaging the base for lateral sliding movement relative to the base forwardly toward the front of the base and rearwardly toward the back of the base between a forward position and rear position, (d) a control arm extending longitudinally over the slide member and secured to the base on opposite sides of the slide member, the control arm being provided with a horizontal threaded through hole positioned above the slide member, (e) a longitudinally extending upright mounting plate positioned over the base and forwardly of the control arm, the mounting plate being secured to the slide member for sliding movement therewith on the base, the mounting plate having a front side and a back side, there being provided a plurality of horizontal clearance holes through the mounting plate between said front and back sides thereof, (f) a horizontal drive screw threaded through the threaded hole in the control arm and extending forwardly and rearwardly therefrom, the forward end of the drive screw rotatably connected to the mounting plate from the back side thereof, the drive screw being manually operable from a position behind the control arm for manually controlling the lateral sliding movement of the slide member and mounting plate together on the base upon turning the drive screw, (g) a plurality of threaded fasteners extending through the clearance holes in the mounting plate from the back side thereof the threaded fasteners being configured for threading directly into a workpiece located on the front side of the mounting plate, and (h) a pair of laterally spaced handles rigidly secured between the back side of the mounting plate and the back of the slide member for sliding movement therewith, the handles extending upwardly from the back of the slide member and forwardly over the control arm to the back side of the mounting plate.

* * * * *